United States Patent [19]

Glackin

[11] 4,189,797

[45] Feb. 26, 1980

[54] MATTRESS

[76] Inventor: Steven Glackin, 309 E. Main St., Wilmington, Del. 19804

[21] Appl. No.: 899,090

[22] Filed: Apr. 24, 1978

[51] Int. Cl.[2] ..... A47C 27/22; A47C 27/14; A47C 27/12

[52] U.S. Cl. ..... 5/448; 5/480

[58] Field of Search ..... 5/355, 345 R, 357, 352, 5/344, 350

[56] References Cited

U.S. PATENT DOCUMENTS 1,211,548 1/1917 Courts ..... 5/355

FOREIGN PATENT DOCUMENTS 6100 of 1902 United Kingdom ..... 5/448

*Primary Examiner*—Mervin Stein
*Assistant Examiner*—Alexander Grosz
*Attorney, Agent, or Firm*—Samuel V. Abramo

[57] ABSTRACT

A firm, shape-retaining mattress made of layers of resilient material separated by a layer of nonwoven material such as jute, which are held in relation to one another by a strong, nonwoven fabric material intertwined among the layers and through slits in the layers in a manner to substantially prevent movement relative to one another.

1 Claim, 2 Drawing Figures

MATTRESS

BACKGROUND OF THE INVENTION

Attempts have been made heretofore to replace the inner springs of an inner spring mattress in order to obtain a simplified unitary construction. However, difficulties have been encountered in such attempts. For example, use of a single resilient pad usually results in sagging due to continued use. However, use of several layers of resilient pads results in a construction whose shape is difficult to maintain due to tendency of the layers to shift during continued use. In the past, better mattresses have been made by using expensive innerspring devices. My invention eliminates this expensive construction method.

SUMMARY OF THE INVENTION

This invention is directed to a mattress which employs several resilient layers and a semirigid layer arranged to maintain their shape during use.

The invention is a layered mattress comprising an assembly of:

(a) a top resilient member, (b) a bottom resilient member, each member containing two vertical slits through the member, which slits are positioned parallel with the ends of the member and which extend in length from between about $\frac{5}{8}$ to $\frac{7}{8}$ of the width of the members, (c) a semirigid member between said top and bottom member containing two slits which substantially coincide with the slits in said bottom member, (d) a nonwoven fabric laced through the slits of the bottom member and the semirigid member, said fabric extending from the bottom edge of one end of the member upwardly over the top edge of the same end, then extending between said top and bottom member to downward through the first coinciding slits in the bottom member and the semirigid member, then upward through the other coinciding slits and finally, downward from the top edge of the other end of the member to the bottom edge of the same end, (e) a second nonwoven fabric partially overlaying the first nonwoven fabric and extending from the bottom edge of one end of the bottom member upwardly over the top edge, then between said top and bottom members to and upward through the first slit in the top member, then extending downward through the second slit and between the top and bottom layers to the top edge of the other end of the bottom member and then down to the bottom edge of said other end, (f) the first and second nonwoven fabrics being affixed to each other along their ends which terminate along the bottom edges of each end of the bottom member, (g) layer felt (cotton) material surrounding the outside of the resilient members, and (h) a flexible, strong cover surrounding the entire assembly.

DESCRIPTION OF THE INVENTION

Figure 1:
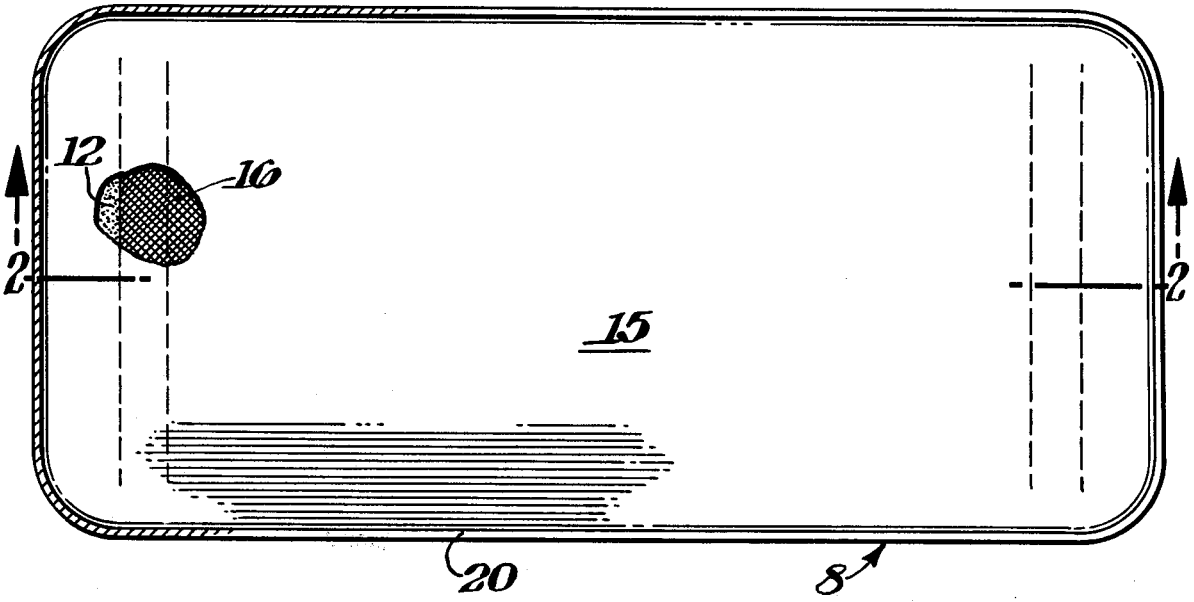
FIG. 1 is a top view of the mattress.

According to the drawing, the mattress 8 is composed of a top resilient layer 10 and a bottom resilient layer 11. Each layer can be of a foam, such as polyurethane. The two layers are slitted along the bottom and top thereof. The slit produces, in cross-section, top end members 12 and 12A and bottom end members 13 and 13A. Between the layers is placed a semirigid member 18 preferably made of jute. The semirigid layer is slitted along the bottom and top to produce in cross section top and bottom members 19 and 19A and preferably are made of the same material as top and bottom layers.

Surrounding the outside of layers 10 and 11 is layer felt 14. Surrounding and enclosing the entire assembly is mattress cover 15 which is of the ordinary construction for mattress covers such as ticking made of cotton, Damas, synthetic materials and the like.

Figure 2:
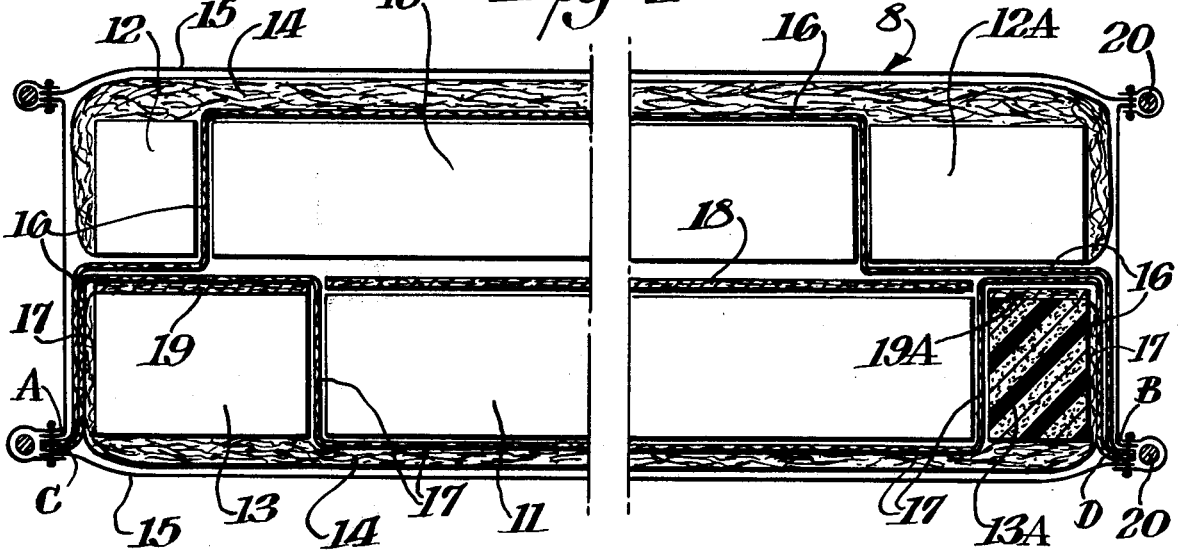
FIG. 2 is a cross-sectional view of the mattress taken through FIG. 1 along line 2—2.

To increase the strength of the assembly and to prevent movement of the resilient layers and members relative to one another, a nonwoven or woven strong fabric is used to bind the layers and members together. The fabric may be a nonwoven material such as "Typar." It has been found that the use of two such fabrics results in a desirable assembly construction. Thus, in the drawings, a first nonwoven or woven fabric 16 begins at point A of FIG. 2 and covers continuously the end and top of bottom end member 13, then covers the ends and top of layer 10, and finally the top and end of member 13A and terminates at point B. The second nonwoven fabric 17 is positioned to form a continuous layer by extending from point C in FIG. 2 along the side top and other side of member 13, along the bottom of layer 11, and finally along the side, top and other side of member 13A and terminates at point D.

The two fabrics are sewn or otherwise affixed or attached together at their ends along points A and points B using a welting cord 20.

I claim:

1. A mattress comprising (a) a top resilient member, (b) a bottom resilient member, each member containing two vertical slits through the member, which slits are positioned parallel with the ends of the member and which extend in length from between about $\frac{5}{8}$ to $\frac{7}{8}$ of the width of the members, (c) a semirigid member between said top and bottom member containing two slits which substantially coincide with the slits in said bottom member, (d) a nonwoven fabric laced through the slits of the bottom member and the semirigid member, said fabric extending from the bottom edge of one end of the bottom member upwardly over the top edge of the same end, then extending between said top and bottom member to downward through the first coinciding slits in the bottom member and the semirigid member, then upward through the other coinciding slits and finally, downward from the top edge of the other end of the member to the bottom edge of the same end, (e) a second nonwoven fabric partially overlaying the first nonwoven fabric and extending from the bottom edge of one end of the bottom member upwardly over the top edge, then between said top and bottom members to and upward through the first slit in the top member, then extending downward through the second slit and between the top and bottom layers to the top edge of the other end of the bottom member and then down to the bottom edge of said other end, (f) the first and second nonwoven fabrics being affixed to each other along their ends which terminate along the bottom edges of each end of the bottom member, (g) felt made of cotton surrounding the outside of the resilient members, and (h) a flexible, strong cover surrounding the entire assembly.

* * * * *